US007118142B2

(12) United States Patent
Xu

(10) Patent No.: US 7,118,142 B2
(45) Date of Patent: Oct. 10, 2006

(54) LATCHING APPARATUS FOR SLIDING CLOSURE MEMBERS

(76) Inventor: Xiangui Xu, 306-7151 Edmonds Street, Burnaby, British Columbia (CA) V3N 4N5

( * ) Notice: Subject to any disclaimer, the term of this patent is extended or adjusted under 35 U.S.C. 154(b) by 71 days.

(21) Appl. No.: 10/901,945

(22) Filed: Jul. 29, 2004

(65) Prior Publication Data

US 2006/0033343 A1 Feb. 16, 2006

(51) Int. Cl.
*E05C 1/06* (2006.01)

(52) U.S. Cl. ..... 292/139; 292/36; 292/175; 292/302; 292/332; 292/333; 292/DIG. 20; 292/DIG. 21; 292/DIG. 37; 292/DIG. 47; 292/DIG. 31

(58) Field of Classification Search ..... 292/139, 292/35, 36, 162–164, 166–168, 175, 241, 292/283, 295, 302, 332, DIG. 20, DIG. 37, 292/DIG. 46, DIG. 47, DIG. 31, 333, DIG. 21
See application file for complete search history.

(56) References Cited

U.S. PATENT DOCUMENTS

| | | | | | |
|---|---|---|---|---|---|
| 160,525 | A | * | 3/1875 | Husted | 292/332 |
| 336,374 | A | * | 2/1886 | Bayrhoffer | 292/168 |
| 683,928 | A | * | 10/1901 | Geraghty | 292/335 |
| 919,750 | A | * | 4/1909 | Neumeister | 292/60 |
| 1,140,343 | A | * | 5/1915 | Arens | 292/333 |
| 1,434,370 | A | * | 11/1922 | Crompton et al. | 292/163 |
| 1,857,943 | A | * | 5/1932 | Dawicki, Jr. | 292/207 |
| 1,919,763 | A | * | 7/1933 | Allen | 70/157 |
| 2,252,591 | A | * | 8/1941 | Anderson | 292/63 |
| 2,587,695 | A | * | 3/1952 | Citso | 292/175 |
| 2,793,896 | A | * | 5/1957 | Duvall | 292/165 |
| 2,927,814 | A | * | 3/1960 | Reitzel | 292/335 |
| 3,077,359 | A | * | 2/1963 | Ettore et al. | 292/3 |
| 3,117,820 | A | * | 1/1964 | Toland et al. | 298/38 |
| 3,148,913 | A | * | 9/1964 | Golde | 296/223 |
| 3,216,756 | A | * | 11/1965 | Ahlgren | 292/169.15 |
| 3,621,686 | A | * | 11/1971 | Klein | 70/157 |
| 4,049,304 | A | * | 9/1977 | Imhoff | 292/333 |
| 4,478,444 | A | * | 10/1984 | Kurz et al. | 292/333 |
| 5,626,374 | A | * | 5/1997 | Kim | 292/170 |
| 5,669,639 | A | * | 9/1997 | Lawrence | 292/175 |
| 5,975,556 | A | * | 11/1999 | Lehmann | 280/624 |
| 6,123,373 | A | * | 9/2000 | Yoshida | 292/241 |
| 6,155,615 | A | * | 12/2000 | Schultz | 292/163 |

(Continued)

FOREIGN PATENT DOCUMENTS

JP 03122386 * 3/1991

(Continued)

*Primary Examiner*—Brian E. Glessner
*Assistant Examiner*—Carlos Lugo
(74) *Attorney, Agent, or Firm*—Brian M. Long

(57) ABSTRACT

A latching apparatus for sliding windows or doors, comprising a striker and a latch assembly. The latch assembly comprises a support, a spring biased latch member slideably retained on the support and movable between a latching position in which it engages the striker and a non-latching position, a spring biased retainer connected to the support and movable between a retaining position in which it retains the latch member in the non-latching position and a non-retaining position in which it releases the latch member to move to the latching position. The retainer includes an actuating portion that is externally engageable by the striker as the frames of the closure are slid closed to move the retainer to the non-retaining position. An actuator is connected to the latch member by for returning the latch member to the non-latching position thereby freeing the frames and the retainer.

15 Claims, 7 Drawing Sheets

U.S. PATENT DOCUMENTS

| | | | | |
|---|---|---|---|---|
| 6,733,049 | B1 * | 5/2004 | Piorkowski et al. | 292/139 |
| 6,764,115 | B1 * | 7/2004 | Speed et al. | 292/334 |
| 6,848,728 | B1 * | 2/2005 | Rotondi et al. | 292/336 |
| 2004/0195843 | A1 | 10/2004 | Rotondi | |
| 2004/0201227 | A1 | 10/2004 | Smith | |
| 2004/0207212 | A1 * | 10/2004 | Wallis | 292/241 |

FOREIGN PATENT DOCUMENTS

| | | |
|---|---|---|
| WO | WO 90/04694 | 5/1990 |
| WO | WO 93/19270 | 9/1993 |

* cited by examiner

LATCHING APPARATUS FOR SLIDING CLOSURE MEMBERS

BACKGROUND OF THE INVENTION

1. Field of the Invention

The present invention is generally related to latching devices for sliding closure members and, more particularly, to latching assemblies for sliding windows and doors. Although the invention is applicable to sliding closure members in general, including doors and windows, the invention will be described below primarily with reference to conventional sliding windows of extruded polyvinyl chloride (PVC) or aluminum frame construction.

2. Description of the Prior Art

Sliding windows are commonly fitted with rotary cam style latching mechanisms mounted above or on the surface of the sash rails for latching the window. The latch commonly requires a rotary motion to actuate the mechanism. The rotary style actuator requires that part of the mechanism housing be visually exposed which can be aesthetically unpleasing, or that the rail be altered to allow the rotary cam to be inset into the top of the sash rail. In addition, rotary cam style latching mechanisms require that the user conscientiously remember to latch the window which could pose a security risk if the user forgets to latch the window.

Accordingly, it would be desirable to have a latching mechanism that secures the window automatically when the window is slid closed, and that is simple to install and requires virtually no alteration to the window frame so as to enable the latching mechanism to be used in conjunction with a variety of sliding window configurations. Furthermore, it would be desirable to have such latching mechanism include a visible indicator which signals to the user when the window is unlatched, and/or when it is latched.

SUMMARY OF THE INVENTION

According to one aspect of the present invention there is provided a latching apparatus for a sliding closure member such as a sliding window or door having at least first and second frames, the apparatus comprising a strike member mountable to the first frame; and a latch assembly mountable to the second frame, the latch assembly comprising a support, a latch member slideably retained on the support and being movable between a latching position in which the latch member engages the strike member, and a non-latching position in which the latch member does not engage the strike member, the latch member being spring biased toward the latching position, a retainer member connected to the support and being movable between a retaining position in which the retainer member blocks the latch member to retain the latch member in the non-latching position and a non-retaining position in which the retainer member does not block the latch member thereby releasing the latch member to move to the latching position, the retainer member being spring biased toward the retaining position, and wherein the retainer member includes an actuating portion that is externally engageable by the strike member to enable the retainer member to be moved to the non-retaining position by the strike member as the first and second frames are brought into close proximity by a user in the act of closing the closure member, and an actuator connected to the latch member by which the user can move the latch member to the non-latching position thereby freeing the second frame and the retainer member to enable the retainer member to move to the retaining position upon separation of the first frame from the second frame by the user.

In another aspect of the present invention, the latch member in the latching position blocks the retainer member in the non-retaining position to maintain the retainer member in the non-retaining position, and wherein the latch member in the non-latching position does not blocks the retainer member thereby releasing the retainer member to move to the retaining position.

In another aspect of the present invention, the support comprises a base member, a latch member housing connected to the base member, and a latch assembly housing connected to the base member. In some aspects, the latch member is slideably retained upon the base member by the latch member housing, the latch assembly housing includes a front wall facing the strike member, and the retainer member is mounted for sliding movement on the front wall. In some embodiments, the direction of movement of the retainer member is generally perpendicular to the direction of movement of the latch member In another aspect of the present invention, the strike member includes a first receiving portion able to receive a part of the latch member when the latch member is in the latching configuration, thereby enabling the first and second frames to be latched. In some embodiments, the first receiving portion comprises at least one slot defined in the strike member.

In another aspect of the present invention, the retainer member further includes a hook portion and the strike member further includes a second receiving portion that is able to receive the hook portion and to be engaged thereby when the strike member contacts the retainer member, thereby reducing the chance of the strike member and the latch member being forced apart.

In another aspect of the present invention, the latch member is spring biased by compression springs that are longitudinally aligned with the latch member.

In other aspects of the present invention, the latching apparatus further includes visual indicators to alert a user when the closure member is not latched, and preferably, to also alert the user when the closure member is latched.

BRIEF DESCRIPTION OF THE DRAWINGS

An example of the present invention will now be described with reference to the accompanying drawings, in which.

DETAILED DESCRIPTION

Reference will now be made in detail to the present preferred embodiments of the invention, examples of which are illustrated in the accompanying drawings wherein like numerals indicate the same elements throughout the views. The invention disclosed herein may be practiced in embodiments in many different forms and it is understood that the present disclosure is an exemplification of the principles of the invention and does not limit the invention to the illustrated embodiments. Therefore, specific details disclosed herein are not to be interpreted as limiting, but rather as a basis for the claims and as a representative basis for teaching one skilled in the art to employ the present invention.

Figure 1:
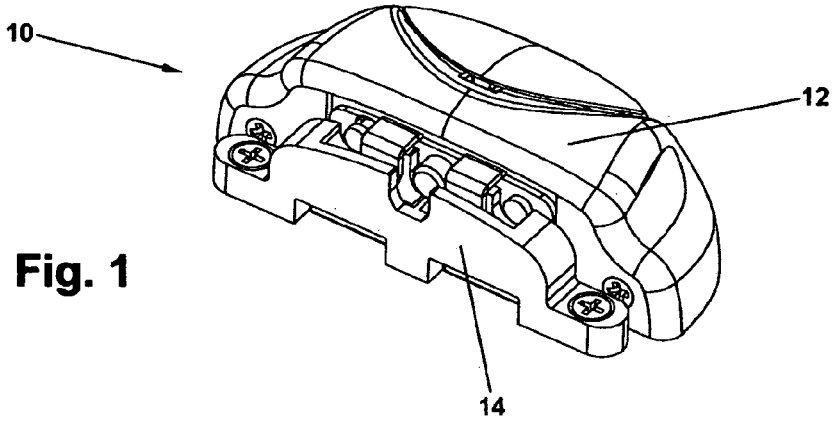
FIG. 1 is perspective view of an embodiment of the present invention showing a latch assembly in conjunction with a striker.
Figure 2A:
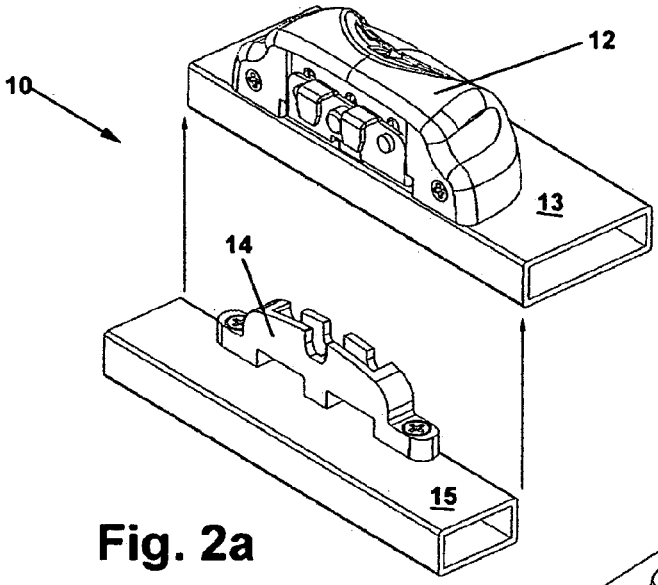
FIGS. 2*a* and 2*b* are perspective views of the embodiment in FIG. 1 shown mounted on respective closure frame members.
Figure 2B:
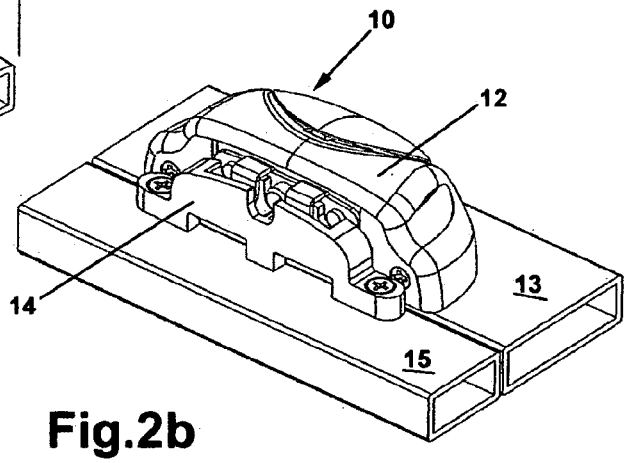

Referring to FIGS. 1 & 2, there is shown a preferred embodiment of the present invention. A latch device is generally indicated by reference numeral 10 and comprises a latch assembly 12 and a strike member such as striker 14. In an operable configuration of the latch device, the striker 14 is mounted on one frame member 15 and the latch assembly 12 is mounted on another frame member 13 of a sliding closure system, such a sliding window or sliding door system, in such a way that when the closure is closed, the striker 14 is brought into close proximity with the latch assembly 12 along a plane of motion that is generally perpendicular to the plane of the surface on which the latch assembly is mounted (see FIGS. 2*a* & 2*b*). While the closure (i.e. window) is open, the striker and latch assembly are apart, but as the closure is slid into a closed position, the striker actuates a latching mechanism in the latch assembly that engages the striker thereby securing the closure into a closed position. Regarding terms of spatial orientation and reference used herein, the latch assembly 12 in FIGS. 1 & 2 should be regarded as being oriented in relation to a horizontal plane or surface. Accordingly, terms such as 'up', 'upper' and 'top' refer to a direction or position away from the plane or surface; terms such as 'side' or 'lateral' pertain to a direction or position away from a midline of the latch assembly; and terms such as 'down', 'lower' or 'under' refer to a direction or position toward the surface. Terms such as 'forward' and 'fore' refer to a direction or position towards the part of the latch assembly that faces the striker 14 when the device is in the latched position. Such terms of orientation are used merely for convenience herein, and it is to be understood that the device of the present invention may be oriented in many planes. For example, the device may be mounted in a vertical plane on a horizontally sliding window frame.

Figure 3:
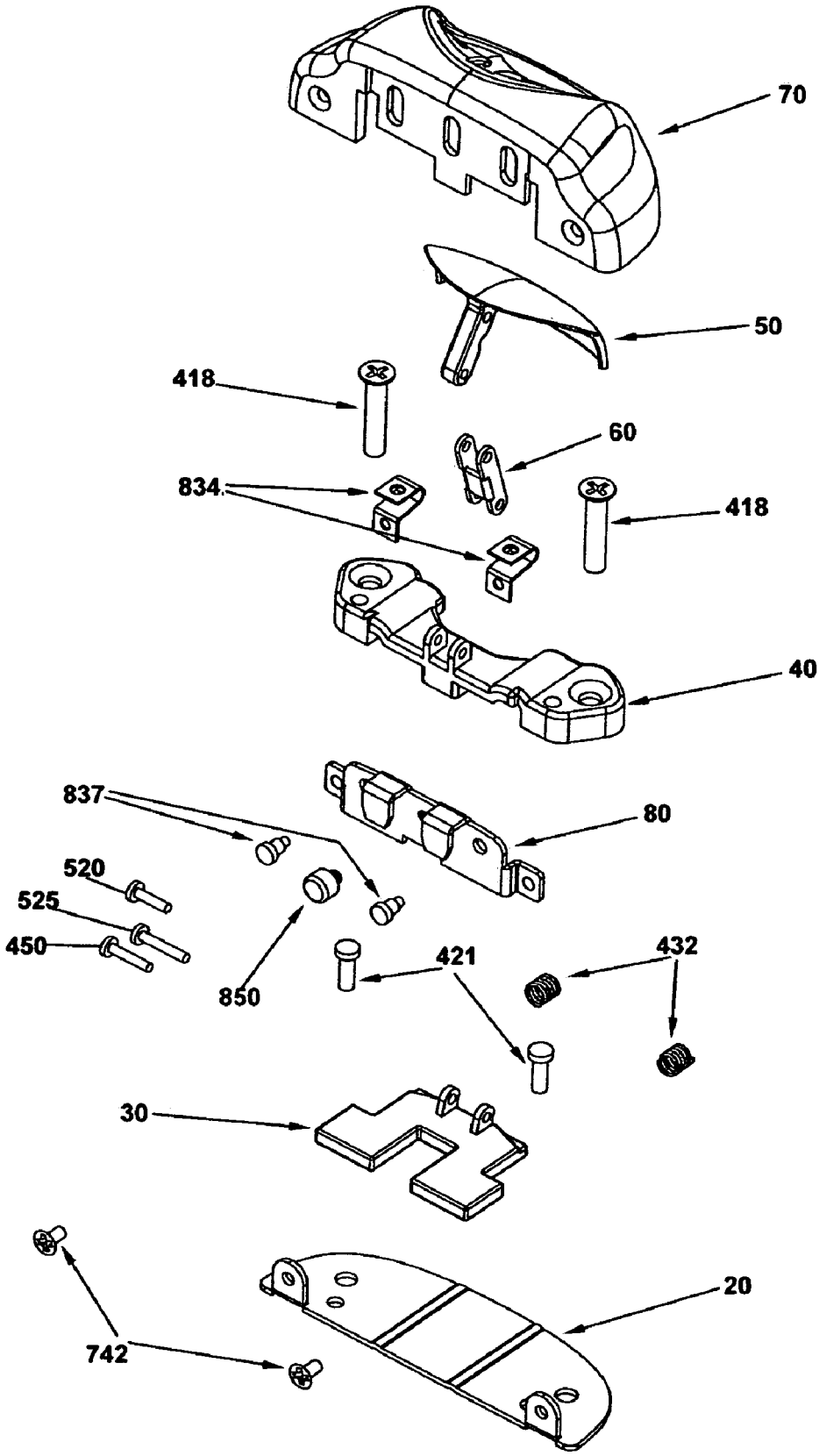
FIG. 3 is an exploded front perspective view of the latch assembly in FIG. 1.

FIG. 3 illustrates an exploded view of latch assembly 12, which generally comprises a base member such as base plate 20, a latch member such as latch bar 30 retained for sliding movement on the base plate 20 by a latch bar housing 40, an actuator 50 mounted to the latch bar housing 40 and to the latch bar 30 by means of a linkage 60, a latch assembly housing 70, and a retainer member or block plate 80 mounted for sliding movement on the latch assembly housing 70. Accordingly, the base plate, latch bar housing and latch assembly housing comprise a support upon which the latch bar is slideably retained and to which the block plate is moveably mounted.

Figure 4:
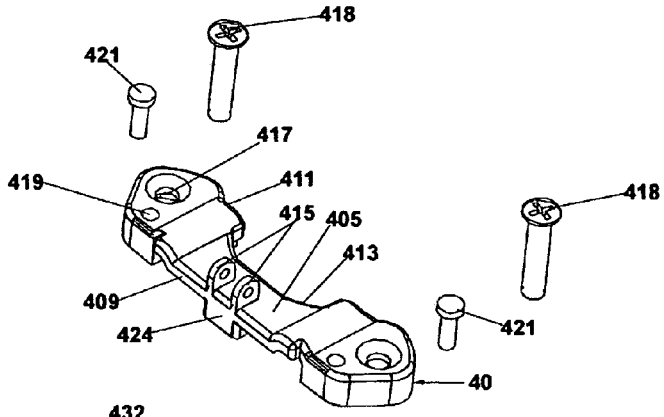
FIG. 4 is an exploded front perspective view of a base plate, latch bar and latch bar housing.
Figure 4:
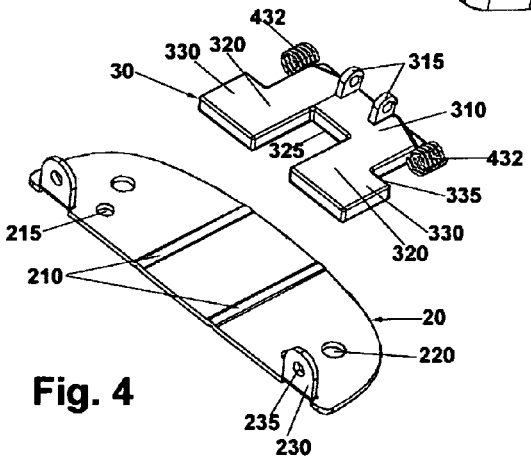

As illustrated in FIG. 4, base plate 20 includes two parallel guide ridges 210, holes 215, and holes 220 for mounting the latch bar housing, latch bar and base plate to a window frame. Flanges 230 are provided on the front surface of the base plate, each having a hole 235.

Figure 5:
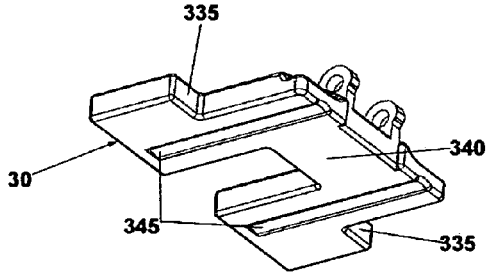
FIG. 5 is a bottom perspective view of a latch bar in FIG. 4.
Figure 6:
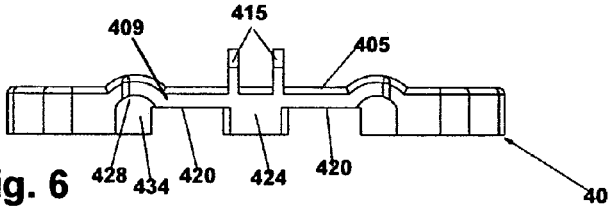
FIG. 6 is a front elevation view of the latch bar housing in FIG. 4.
Figure 7:
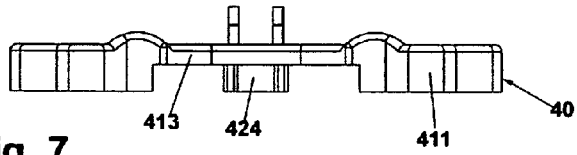
FIG. 7 is a rear elevation view of the latch bar housing in FIG. 4.
Figure 8:
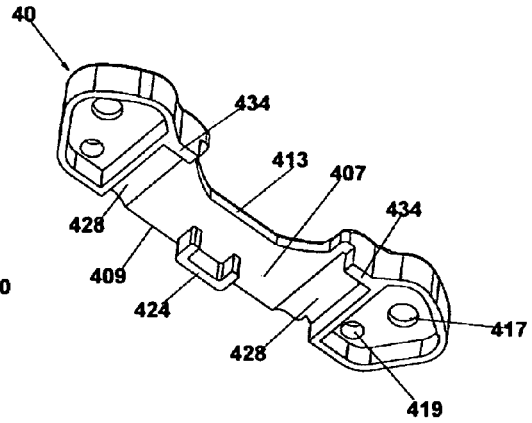
FIG. 8 is a bottom perspective view of the latch bar housing in FIG. 4.
Figure 9:
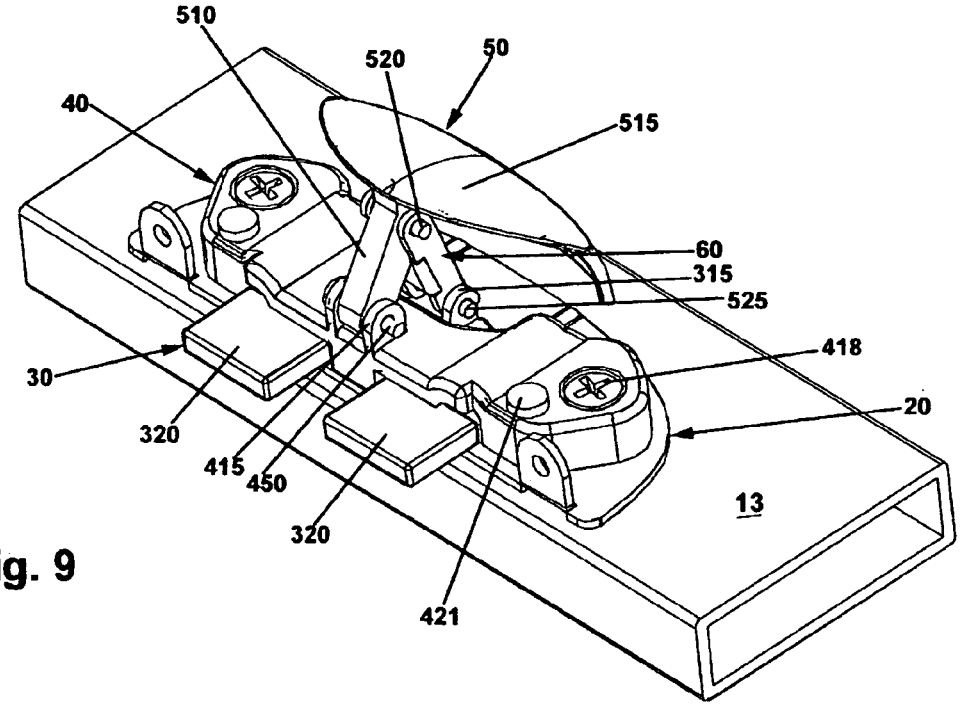
FIG. 9 is a top perspective view of a partially assembled latch assembly showing the relationship of the base plate, latch bar, latch bar housing, linkage and actuator of FIG. 3.

Referring to FIGS. 4 & 5, latch bar 30 includes a main portion 310 having lugs 315 for connecting to linkage 60, and projections 320 extending in a forward direction from the main portion 310 and defining a central slot 325 in the latch bar. The projections 320 include lateral extensions 330 that define shoulders 335 in relation to the main portion 310. Preferably, the latch bar 30 is sized to fit within the latch assembly housing 70 so that the latch bar is concealed therein for aesthetics. On lower side 340 on the latch bar 30 are provided parallel grooves 345 that are complimentary in position to ridges 210 on the base plate, but are slightly shallower than the height of said ridges such that the ridges provide the only means of contact between the latch bar 30 and the base plate 20 thereby reducing the amount of sliding friction between the latch bar and base plate. The latch bar 30 is retained on the base plate for sliding movement in relation thereto and is retained in place by the latch bar housing 40 (as shown in FIG. 9). The ridges 210 on the base plate cooperate with the grooves 345 on the latch bar to guide the movement of the latch bar.

Referring to FIGS. 4, and 6–8, the latch bar housing 40 is shown to include a top surface 405, an inside surface 407, a front surface 409, a rear surface 411 and a centrally located recessed rear surface portion 413. The recessed portion 413 is dimensioned to expose the lugs 315 of the latch bar 30 when the latch bar housing 40 is positioned over the latch bar 30 upon assembly of the latch assembly 12, and to enable the latch bar 30 to slide forward into a latched configuration of the latch assembly (see FIG. 9).

Located centrally on the top surface 405 of the latch bar housing and adjacent the front surface 409 are provided lugs 415 by which the actuator 50 is connected for articulated movement in relation to the latch bar housing by means of a rivet 450. Located laterally on the latch bar housing are countersunk mounting holes 417, which line up with holes 220 on the base plate 20 and are for mounting the latch bar housing and the base plate to the window frame by means of screws 418. Also included are holes 419 which line up with holes 215 on the base plate 20 and are for assembling the latch bar housing, latch bar and base plate by means of rivets 421.

Referring to FIGS. 6–11 slots 420 are defined in the front surface 409 of the latch bar housing on each side of a central tab 424. The slots 420 are slightly wider than the projections 320 of the latch bar so that the projections can be received within the slots 420, and the central tab 424 is slightly narrower than the central slot 325 of the latch bar so that the central tab 424 can be received in the central slot 325. Accordingly, the slots 420 and the central tab 424 of the latch bar housing serve to retain and guide the latch bar 30 during movement of the latch bar between a latched and unlatched configuration. On the inside surface 407 of the latch bar housing are provided semi-cylindrical channels 428, each for receiving compression springs 432 in the assembled latch assembly so that the compression springs are longitudinally aligned with the latch bar. Each channel includes a terminal wall 434 against which an end of the compression spring abuts.

Figure 10:
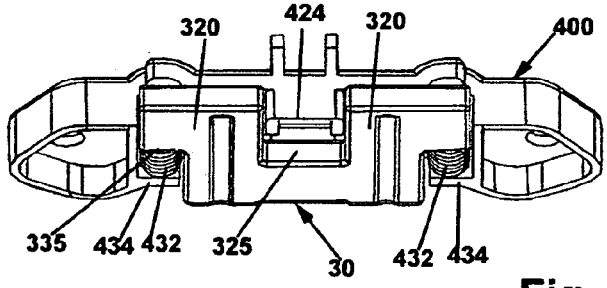
FIG. 10 is a bottom perspective view of the latch bar and latch bar housing.
Figure 11:
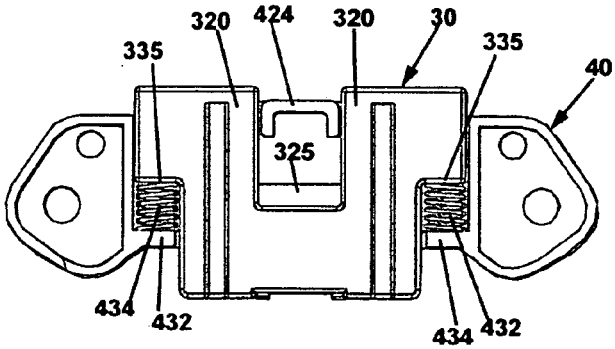
FIG. 11 is a bottom plan view of the latch bar and latch bar housing of FIG. 10.
Figure 12:
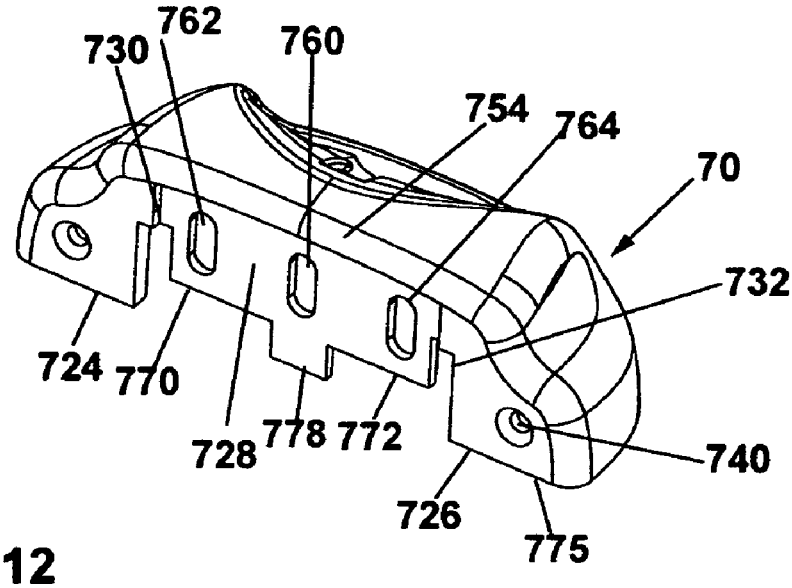
FIG. 12 is a frontal perspective view of the latch assembly housing of FIG. 3.
Figure 13:
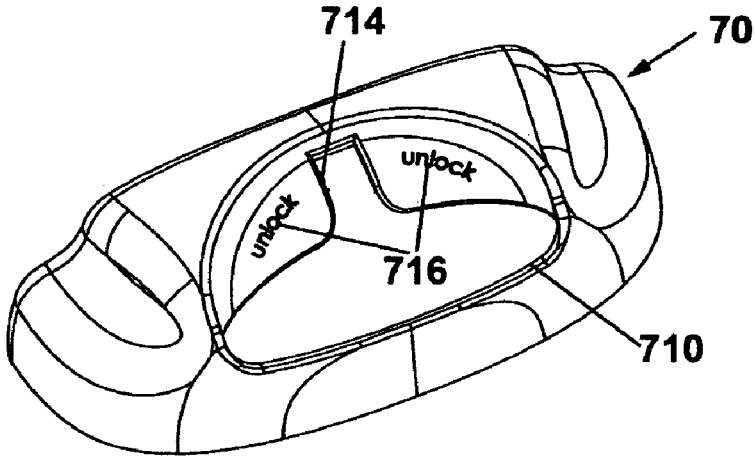
FIG. 13 is a rear perspective view of the latch assembly housing of FIG. 3.
Figure 14:
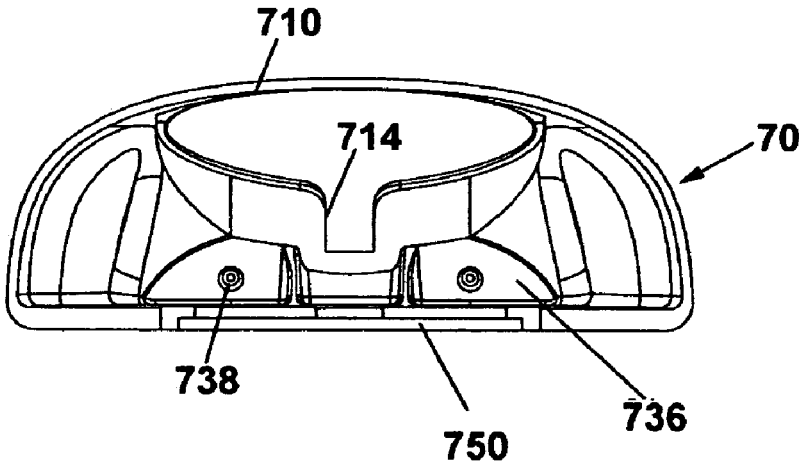
FIG. 14 is a bottom plan view of the latch assembly housing of FIG. 3.

In FIGS. 10 & 11, the latch bar 30 and latch bar housing 40 are shown from the bottom showing their cooperation. The latch bar and latch bar housing are dimensioned so that the latch bar is slideably received in the latch bar housing. In particular, the projections 320 on the latch bar fit into the slots 420 on the latch bar housing, the central tab 424 on the latch bar housing fits into the central slot 325 on the latch bar, and each lateral extension 330 of the projection 320 intrudes into the respective channel 428 of the latch bar housing such that each compression spring 432 within the channel 428 is able to abut the shoulder 335 of the latch bar, thereby urging the latch bar in a forward direction to provide the motive force to slide the latch bar into a latched position. Preferably, the length of each compression spring 432 is such that the compression spring is under compression forces throughout the range of motion of the latch bar 30 in the assembled device.

FIG. 9 shows a partially assembled latch assembly wherein the latch bar 30 is retained between the base plate 20 and latch bar housing 40 by means of rivets 421, and these are also mounted to a window frame 13 by means of screws 418. The actuator 50 comprises a shaft 510 and a button 515 which is attached to one end of the shaft 510. The end of the shaft remote from the button is connected to lugs 415 on the latch bar housing by rivet 450 that passes through the lugs and the shaft for articulated movement there between. With the base plate 20, latch bar 30 and the latch bar housing 40 in place (so that the latch bar is sandwiched between the latch bar housing and base plate) the linkage 60 connects the actuator 50 to the lugs 315 on the latch bar by means of rivets 520 and 525. The points of connection between the linkage 60 and shaft 510, and the linkage 60 and lugs 315 are such that the rivet 520 is positioned forward relative to the rivet 525, thereby enabling the linkage to transmit force applied by a user to the button 515 into rearward sliding motion of the latch bar, and to transmit forward force applied to the latch bar 30 by the compression springs 432 into upward movement of the button 515.

Referring to FIGS. 12–20, there is shown the latch assembly housing 70 and the block plate 80. The latch assembly housing 70 is generally hollow and is sized and shaped to encompass the mechanisms of the latch while providing an aesthetically pleasing exterior. The latch assembly housing 70 includes a generally oval aperture 710 having a slot 714. Also included is a first visual indicator such as 'unlock' indicator 716 on portions of the latch assembly housing adjacent the slot 714 that are recessed inward from the rest of the latch assembly housing. The aperture 710 is shaped to be complimentary to the button 515 of the actuator 50 whereby the button 515 fits closely into the aperture 710. The slot 714 provides clearance for the shaft 510 of the actuator 50.

The latch assembly housing 70 also includes a front wall which is divided into side wall portions 724, 726 and a central wall portion 728 by slots 730 and 732. On each of the side wall portions (724, 726) are provided countersunk mounting holes 740 which align with holes 235 on the base plate 20 for mounting the latch assembly housing to the base plate by screws 742. The thickness of the central wall portion 728 is less than the side wall portions 724, 726 such that a ledge 750 is defined at the juncture of the central wall with top wall 754. The central wall portion 728 defines a central oval hole 760 and two side oval hole 762 and 764. The lower side surfaces 770,772 of the central wall portion 728 are raised in relation to the lower surface 775 of the latch assembly housing, thereby defining a tab 778 on the central wall portion. In the assembled latch assembly, the offset of the lower side surfaces 770,772 on the latch assembly housing provide clearance for the passage of the projections 320 of the latch bar 30 when it is moved into a latched configuration, wherein the tab 778 of the central wall portion 728 fits within the slot 325 of the latch bar.

Figure 15:
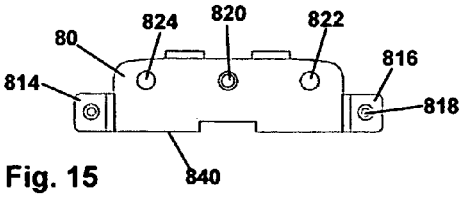
FIG. 15 is a rear plan view of the block plate of FIG. 3.
Figure 16:
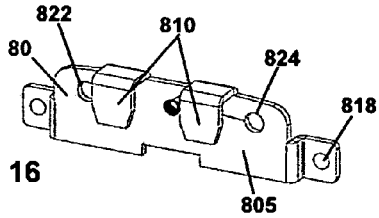
FIG. 16 is a front perspective view of the block plate of FIG. 3.
Figure 17:
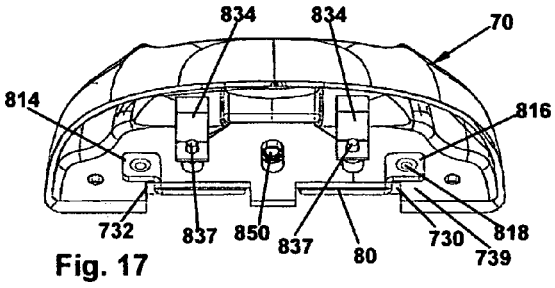
FIG. 17 is a bottom perspective view of the latch assembly housing with the block plate mounted therein.
Figure 18:
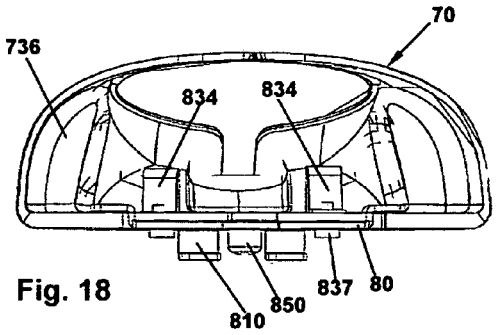
FIG. 18 is a bottom plan view of the latch assembly housing and the block plate of FIG. 17.
Figure 19:
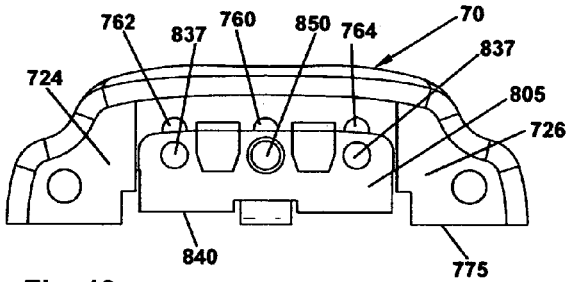
FIG. 19 is a front elevation view of the latch assembly housing and the block plate of FIG. 17 in the retaining position.
Figure 20:
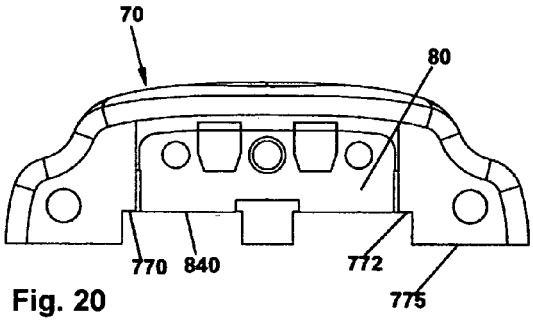
FIG. 20 is a front elevation view of the latch assembly housing and the block plate of FIG. 17 in the non-retaining position.

Shown in FIGS. 15 & 16 is the block plate 80 having a hook portion such as hooks 810, side tabs 814,816 that are offset from the plane of the block plate, a central threaded hole 820 and two side holes 822,824. Each of the side tabs 814,816 includes a forward facing protuberance 818. As shown in FIGS. 17–20, the side tabs 814,816 of the block plate 80 are received within the slots 730,732 of the latch assembly housing 70 for sliding movement therein, and each protuberance 818 abuts inside surface 739 of the front wall of the latch assembly housing thereby reducing the amount of sliding friction between the block plate 80 and the latch assembly housing 70. The holes 820,822,824 on the block plate align with the oval holes 760,762,772 on the central wall portion 728 of the latch assembly housing. On the inside upper surface 736 of the latch assembly housing are provided spring clips 834 (FIGS. 17 & 18), one spring clip being adjacent side oval hole 762 and the other spring clip being adjacent later oval hole 764. The block plate 80 is connected to the spring clips 834 by rivets 837 that pass through holes 822,824 and corresponding side oval holes 762,764 to connect with the spring clips. Each of the spring clips 834 is retained relative to the latch assembly housing 70 by protrusions 738. Preferably, face 805 of the mounted block plate is flush with the side wall portions 724,726. Accordingly, the block plate 80 is spring biased when mounted on the latch assembly housing 70 by means of the spring clips. The side oval holes 762,764 limit the travel of the block plate 80 and are accordingly sized to permit the block plate to travel between a retaining position in which the lower surface 840 of the block plate is almost flush with the lower surface 775 of the latch assembly housing (FIG. 19), and a non-retaining position in which the lower surface 840 of the block plate is flush with the lower side surfaces 770,772 of the central wall portion of the latch assembly housing (FIG. 20). The block plate 80 includes an actuating portion such as trigger screw 850 mounted in the central threaded hole 820 of the block plate. The trigger screw cooperates with the striker when the window is closed (as will be explained shortly) to move the block plate 80 from the retaining position to the non-retaining position against the biasing force of the spring clips. It is important to note that the actuating portion of the block plate, such as the trigger screw 850, is external to the latch assembly housing so that it is externally engageable by the striker 14. By having the actuating portion externally engageable by the striker, the latch mechanism of the present invention can be readily mounted to many industry standard sliding window or door frames without necessitating modifications to the frame members.

Figure 21:
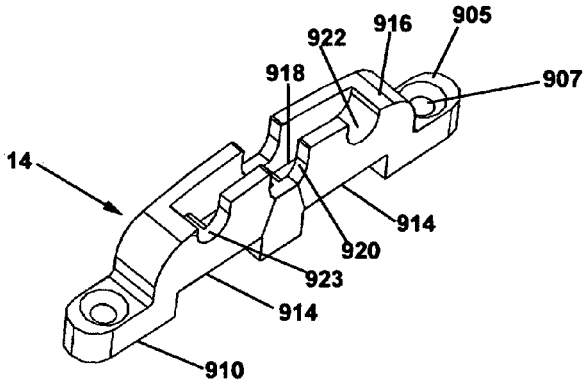
FIG. 21 is a perspective view of the striker of FIG. 1.

FIG. 21 illustrates a preferred embodiment of the striker 14. The striker is generally elongate having mounting flanges 905 at each end with a countersunk hole 907 through which the striker is secured to the window frame by screws. The striker includes a first receiving portion such as slots 914 defined in the lower surface 910. The striker further includes a second receiving portion such as longitudinal channel 918 defined in the top surface 916. The top surface further defines a central transverse notch 920, and side transverse notches 922, 923. The central transverse notch 920 cooperates with the trigger screw 850 on the block plate 80 to move the block plate from the retaining position to the non-retaining position against the biasing force of the spring clips. The side transverse notches 922,923 provide clearance for the rivets 837.

Figure 22:
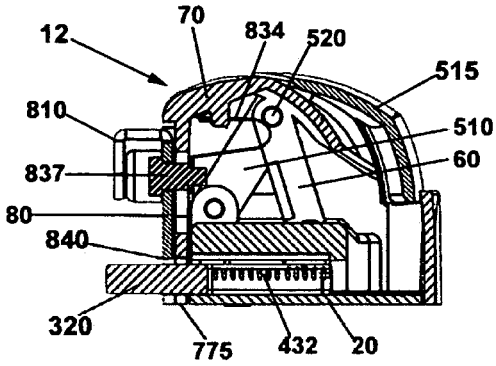
FIG. 22 is a side cross section view of the latch assembly along line A—A as shown in FIG. 24 in a latched configuration.
Figure 23:
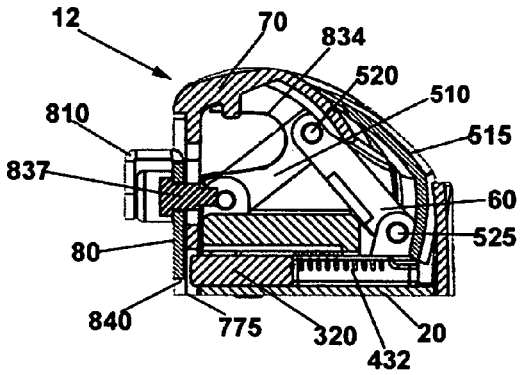
FIG. 23 is a side cross section view of the latch assembly of FIG. 22 in an unlatched configuration.
Figure 24:
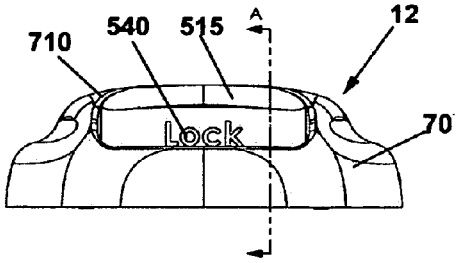
FIG. 24 is a rear plan view of the latch assembly of FIG. 1 in a latched configuration.
Figure 25:
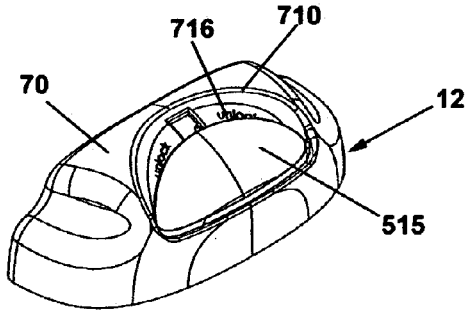
FIG. 25 is a rear perspective view of the latch assembly of FIG. 1 in an unlatched configuration.

In FIGS. 22 & 24, the latch assembly 12 is shown in a latched configuration, and in FIGS. 23 & 25, it is shown in an unlatched configuration. In the unlatched configuration, the block plate 80 is in its retaining position whereby the lower surface 840 of the block plate is almost flush with the lower surface 775 of the latch assembly housing. In this position, the block plate 80 blocks the projections 320 on the latch bar 30 thereby retaining the latch bar in a non-latching position within the latch assembly housing against the biasing force of the compression springs 432. Note that as a result of the linkage between the actuator 50, the latch bar housing 40, and the latch bar 30, the button 515 is somewhat withdrawn into the oval aperture 710 of the latch assembly housing 70.

As shown in FIGS. 1 & 2, when the window upon which the device is mounted is slid closed, the striker 14 engages the trigger screw 850 to displace the block plate 80 upward from the retaining position thereby freeing the latch bar 30. As a result, the latch bar 30 is urged outward by the compression springs 432 into a latching position in which the projections 320 protrude from the latch assembly to slide into slots 914 on the striker thereby engaging the striker to latch the window frames together. The hooks 810 fit into the longitudinal channel 918 on the striker to prevent the striker being disengaged forced away from the grip of the latch bar. The movement of the latch bar is transmitted to the actuator 50 by the linkage 60 and causes the button 515 to be pushed outward so that it becomes generally flush with the latch assembly housing when the latch assembly is in the latched configuration. Referring to FIG. 24, when the button 515 is in this position, the unlock indicator 716 on the latch assembly housing 70 is obstructed from view and a second visual indicator such as 'lock' indicator 540 on the button 515 is visible, thereby providing a visible indication to a user as to the locked status of the window.

To disengage the latching mechanism so that the window frames to be slid apart, a user depresses the button 515 into the latch assembly housing 70 which, on account of the linkage 60, causes the latch bar 30 to be withdrawn into the latch assembly housing against the biasing force of the compression springs. Once the latch bar is withdrawn from within the slots 914 of the striker, the window frames can be slid apart. As the projections 320 of the latch bar clear the lower surface 840 of the block plate 80, and upon the window frames being slid apart by a user such that the striker 14 is disengaged from the trigger screw 850, the biasing force of the spring clips 834 causes the block plate 80 to slide into the retaining position and thereby retain the latch bar within the housing when the user's depressing force is disengaged from the button 515. An advantage to this configuration is that if a user depresses the button 515 to draw the latch bar into the latch assembly housing, but does not slide the window frames apart, then upon the user releasing the button, the latch bar will slide back into engagement with the striker to maintain the frames in a latched state. This reduces the chance of the window frames being accidentally unlatched. On account of the linkage 60, when the latch bar 30 is in the unlatched position, button 515 is partially withdrawn into the latch assembly housing 70. Referring to FIG. 25, in this position, the unlock indicator 716 on the latch assembly housing 70 is visible, whereas the lock indicator 540 on the button 515 is obstructed from view, thereby providing a visible indication to a user as to the unlocked status of the window.

As will be apparent to those skilled in the art, various modifications and adaptations are possible in the practice of this invention without departing from the spirit or scope thereof. Accordingly, the scope of the invention is to be construed in accordance with the substance defined by the following claims.

I claim:

1. A latching apparatus for a closure comprising a first frame and a second frame the latching apparatus comprising:

a strike member for mounting to the first frame; and a latch assembly for mounting to the second frame, the latch assembly comprising:

a support including a base member and a latch assembly housing connected to the base member, the latch assembly housing including a front wall facing the strike member;

a latch member slidably retained on the support and movable between a latching position in which the latch member engages the strike member, and a non-latching position in which the latch member does not engage the strike member, a first spring biasing the latch member toward the latching position, the support including a latch member housing connected to the base member, the latch member being slidably retained upon the base member by the latch member housing:

a retainer member connected to the support and movable between a retaining position in which the retainer member blocks the latch member to retain the latch member in the non-latching position and a non-retaining position in which the retainer member does not block the latch member thereby releasing the latch member to move to the latching position, the latch member in the latching position blocking the retainer member in the non-retaining position and the latch member in the non-latching position not blocking the retainer member thereby allowing it to move to the retaining position, the retainer member being mounted for sliding movement on the front wall, a second spring biasing the retainer member toward the retaining position, and wherein the retainer member includes an actuating portion that is externally engageable by the strike member for moving the retainer member to the non-retaining position as the first and second frames are brought into close proximity by a user in the act of closing the closure member; and an actuator connected to the latch member by which the user can move the latch member to the non-latching position for freeing the second frame and the retainer member and enabling the retainer member to move to the retaining position upon separation of the first frame from the second frame by the user.

2. The apparatus as claimed in claim 1, wherein the direction of movement of the retainer member is generally perpendicular to the direction of movement of the latch member.

3. The apparatus as claimed in claim 2, wherein the base member includes an top surface facing the latch member and having at least one pair of parallel ridges aligned in the direction of movement of the latch member for reducing the sliding friction between the latch member and base member.

4. The apparatus as claimed in claim 3, wherein the latch member includes a bottom surface facing the base member and defining corresponding channels to said ridges, the channels being of shallower depth than the height of the ridges for guiding the movement of the latch member and reducing the sliding friction between the latch member and base member.

5. The apparatus as claimed in claim 1, wherein the strike member includes a first receiving portion for receiving a part of the latch member when the latch member is in the latching position, thereby latching the first and second frames.

6. The apparatus as claimed in claim 5, wherein the first receiving portion comprises at least one slot defined in the strike member.

7. The apparatus as claimed in claim 5, wherein the retainer member further includes a hook portion and the strike member further includes a second receiving portion for receiving the hook portion and being engaged thereby as the strike member contacts the retainer member, thereby reducing the chance of the strike member and latch member being forced apart.

8. The apparatus as claimed in claim 7, wherein the latch member is spring biased by compression springs that are longitudinally aligned with the latch member.

9. The apparatus as claimed in claim 8, wherein the actuator is further connected to the latch bar housing so that movement of the latch bar translates to movement of the actuator.

10. The apparatus as claimed in claim 9, further including a first visual indicator on the latch assembly housing that is obstructed from view by the actuator when the latch bar is in the latching position, and that is visible when the latch member is in the non-latching position, thereby alerting the user when the closure member is not latched.

11. The apparatus as claimed in claim 10, further including a second visual indicator on the actuator that is obstructed from view by the latch assembly housing when the latch bar is in the non-latching position, and that is visible when the latch member is in the latching position, thereby confirming the latched status of the closure member to the user.

12. A latching apparatus for a closure comprising a first frame and a second frame, the latching apparatus comprising:

a strike member for mounting to the first frame; and a latch assembly for mounting to the second frame, the latch assembly comprising:

a support;

a latch member slidably retained on the support and movable between a latching position in which the latch member engages the strike member, and a non-latching position in which the latch member does not engage the strike member, a first spring biasing the latch member toward the latching position;

a retainer member connected to the support and movable between a retaining position in which the retainer member blocks the latch member to retain the latch member in the non-latching position and a non-retaining position in which the retainer member does not block the latch member thereby releasing the latch member to move to the latching position, a second spring biasing the retainer member toward the retaining position, the retainer member includes an actuating portion that is externally engageable by the strike member for moving the retainer member to the non-retaining position as the first and second frames are brought into close proximity by a user in the act of closing the closure member; and an actuator movable into a first position, in which the actuator moves the latch member to the non-latching position thereby enabling the retainer member to move to the retaining position for freeing the second frame from the first frame, and into a second position, in which the actuator moves the latch member to the latching position thereby engaging the strike member;

the latch assembly comprising a latch assembly housing and the actuator being substantially flush with the latch assembly housing in the second position of the actuator and recessed in the latch assembly housing in the first position of the actuator.

13. The latching apparatus as claimed in claim 12, wherein the support comprises a base member, a latch member housing connected to the base member, and a latch assembly housing connected to the base member.

14. The latching apparatus as claimed in claim 13, wherein the latch assembly housing includes a front wall facing the strike member, and the retainer member is mounted for sliding movement on the front wall.

15. The latching apparatus as claimed in claim 14, wherein the front wall has a surface and a recessed portion in the surface, and the retainer member is mounted for sliding movement within the recessed portion on the front wall, whereby the retainer member is flush with the surface of the front wall.

* * * * *